US012336561B2

(12) United States Patent
Batista et al.

(10) Patent No.: US 12,336,561 B2
(45) Date of Patent: Jun. 24, 2025

(54) AEROSOL GENERATING ARTICLES

(71) Applicant: PHILIP MORRIS PRODUCTS S.A., Neuchatel (CH)

(72) Inventors: Rui Nuno Batista, Morges (CH); Eva Ferrari, Zola Predosa (IT); Yves Jordil, Lausanne (CH); Poh Yoke Tritz, Yverdon-les-Bains (FR)

(73) Assignee: Philip Morris Products S.A., Neuchatel (CH)

( * ) Notice: Subject to any disclaimer, the term of this patent is extended or adjusted under 35 U.S.C. 154(b) by 0 days.

(21) Appl. No.: 18/513,977

(22) Filed: Nov. 20, 2023

(65) Prior Publication Data

US 2024/0081391 A1 Mar. 14, 2024

Related U.S. Application Data

(62) Division of application No. 16/978,264, filed as application No. PCT/EP2019/054546 on Feb. 25, 2019, now Pat. No. 11,839,234.

(30) Foreign Application Priority Data

Mar. 8, 2018 (EP) ..... 18160817

(51) Int. Cl.
*A24D 3/02* (2006.01)
*A24D 3/04* (2006.01)
(Continued)

(52) U.S. Cl.
CPC ..... *A24D 3/0237* (2013.01); *A24D 3/04* (2013.01); *A24D 3/17* (2020.01); *A24F 42/60* (2020.01); *A24F 42/80* (2020.01)

(58) Field of Classification Search
CPC ..... A24D 3/027; A24D 3/0237
See application file for complete search history.

(56) References Cited

U.S. PATENT DOCUMENTS 2,979,058 A 4/1961 Schur
4,854,331 A 8/1989 Banerjee
(Continued)

FOREIGN PATENT DOCUMENTS

CH 660836 5/1987
GB 2 119 221 11/1983
(Continued)

OTHER PUBLICATIONS

Translation of KR 20190115819 (Year: 2019).*
(Continued)

*Primary Examiner* — Cynthia Szewczyk
(74) *Attorney, Agent, or Firm* — Mueting Raasch Group

(57) ABSTRACT

A filter part (1, 1') for use in an aerosol generating article and a method of manufacturing the filter part (1, 1'). The filter part (1, 1') includes an aerosol permeable core (2) within a sleeve (3) formed integrally therearound. The core (2) is shorter than the integrally formed sleeve (3). The method includes conveying a plurality of aerosol permeable cores (2) along a conveying path at a first speed (S1) and forming a sleeve (3) around each core (2) at a second speed (S2). The second speed (S2) is greater than the first speed (S1) to generate a space between consecutive cores (2) within the sleeve (3).

7 Claims, 3 Drawing Sheets

(51) Int. Cl.

| | |
|---|---|
| ***A24D 3/17*** | (2020.01) |
| ***A24F 42/60*** | (2020.01) |
| ***A24F 42/80*** | (2020.01) |

(56) References Cited

U.S. PATENT DOCUMENTS

| | | | | |
|---|---|---|---|---|
| 5,060,664 | A * | 10/1991 | Siems | A24C 5/3412 131/84.1 |
| 9,820,506 | B2 | 11/2017 | Rasouli | |
| 2011/0034309 | A1* | 2/2011 | Eusepi | A24D 3/0287 493/39 |
| 2011/0041861 | A1 | 2/2011 | Sebastian | |
| 2019/0183167 | A1* | 6/2019 | Zadecki | B65G 47/848 |

FOREIGN PATENT DOCUMENTS

| | | | |
|---|---|---|---|
| JP | 2001-120250 | | 5/2001 |
| JP | 2017-518041 | | 7/2017 |
| KR | 20190115819 | A * | 10/2019 |
| WO | WO 2012/123702 | | 9/2012 |
| WO | WO 2013/068337 | | 5/2013 |
| WO | WO 2013/187676 | | 12/2013 |
| WO | WO 2014/020055 | | 2/2014 |
| WO | WO 2014/060455 | | 4/2014 |
| WO | WO 2017/198995 | | 11/2017 |

OTHER PUBLICATIONS

PCT Search Report and Written Opinion for PCT/EP2019/054546 dated Apr. 2, 2019 (10 pages).

Extended European Search Report for Application No. 18160817.5 dated Aug. 29, 2018 (8 pages).

International Preliminary Report on Patentability for PCT/EP2019/054546 dated Mar. 30, 2020 (11 pages).

Office Action issued in Europe for Application No. 19706633.5 dated Oct. 25, 2021 (6 pages).

Office Action issued in Korea for Application No. 10-2020-7024429 dated Feb. 27, 2025 (7 pages). English translation included.

* cited by examiner

AEROSOL GENERATING ARTICLES

This application is a divisional application of U.S. application Ser. No. 16/978,264 filed Sep. 4, 2020 and which is a U.S. National Stage Application of International Application No. PCT/EP2019/054546 filed Feb. 25, 2019, which was published in English on Sep. 12, 2019 as International Publication No. WO 2019/170455 A1. International Application No. PCT/EP2019/054546 claims priority to European Application No. 18160817.5 filed Mar. 8, 2018.

This invention relates generally to aerosol generating articles. More specifically, although not exclusively, this invention relates aerosol permeation elements used in tubular shaped aerosol generating articles including, in particular, such aerosol generating articles configured to heat aerosol forming substrates without burning them. This invention also relates to methods of manufacturing such articles and elements.

The filter part or cooling part of an aerosol generating article performs several functions and, as such, several of its properties must be considered in its design and manufacture. The main role of the filter part is filtration or cooling efficiency, namely its effectiveness in removing unwanted components of the aerosol, but this must always be balanced with the overall resistance to draw, which is the pressure drop experienced as the aerosol passes through the filter. An additional complication with aerosol generating articles configured to heat aerosol forming substrates without burning them is that the quantity of sensory media tends to be more closely packed. As such, the inherent resistance to draw provided by the sensory media in such aerosol generating articles is generally much higher than that of traditional combustible aerosol generating articles.

There are several other requirements of the filter part which result from its interaction with the mouth of a consumer. These include, for example, structural rigidity and resistance to wetting. The filter part of an aerosol generating article can often experience significant compressive forces exerted thereon by the consumer. Some consumers also enjoy chewing the filter part and often have expectations as to its resistance to compressibility. The structure of the filter part must be able to withstand such forces, whilst both continuing to perform its main function. The filter part must also continue to function despite exposure to saliva and should minimise or prevent its transmission therethrough to avoid wetting of the aerosol forming substrate.

These competing requirements, namely effective filtering, minimal resistance to draw, compressibility and resistance to wetting, must all be balanced in the final product. It would therefore be advantageous to provide an aerosol permeation element which provides a balance between these competing factors.

One known method of manufacturing filter parts of aerosol generating articles involves pulling a continuous rod of filter material, for instance cellulose acetate, on a moving band of wrapping paper, which is closed and glued around the rod. The continuous wrapped rod is then cut into lengths or sticks, which are then joined to the rest of the aerosol generating article by a tipping paper, which provides the requisite resistance to wetting. The wrapping paper is generally hard for resisting mouth pressure, which makes it difficult to shape. Moreover, it can impact the taste of the aerosol and the gluing process can present challenges.

Another known method of manufacturing filter parts of smoking articles involves the use of a laminated poly lactic acid (PLA) sheet in place of the hard wrapping paper. PLA sheets are more straightforward to shape, resist saliva and air transmission and are biodegradable. However, such sheets still share some of the same disadvantages as wrapping paper.

It would therefore be advantageous to provide an alternative method of manufacturing an aerosol permeation element, preferably one which at least mitigates one or more issues associated with known smoking articles.

Accordingly, a first aspect of the invention provides an aerosol permeation element for use in an aerosol generating article, the aerosol permeation element comprising an aerosol permeable core within a sleeve formed integrally therearound, wherein the core is shorter than the integrally formed sleeve.

The provision of an integral sleeve that is longer than the core enables a portion of the integral sleeve to be used as an interface with the rest of the aerosol generating article, thereby providing an effective alternative to prior art constructions. In addition, such free space or gap might enable a further cooling or mixing of aerosol before delivery to a user.

The length of the core may be between 2 millimetres and 10 millimetres, for example between 3 millimetres and 8 millimetres, such as between 4 millimetres and 7 millimetres. The length of the sleeve may be between 20 millimetres and 200 millimetres, for example between 60 millimetres and 150 millimetres, such as between 50 millimetres and 120 millimetres. The core may be 80 percent or 75 percent or less, for example no more than half of the length of the sleeve. In embodiments, the core is between 2 percent and 15 percent, such as between 4 percent and 7 percent, of the length of the sleeve. The aerosol permeation element may comprise one end or side that may be hollow, for example, a first end or a hollow end or a first hollow end. The aerosol permeation element may comprise another or second end or side, for example, with the aerosol permeable core therein.

The sleeve may comprise a polymeric extrusion. The sleeve may comprise a poly lactic acid material, for example an extruded poly lactic acid material or other polymeric compound or extruded poly lactic acid material and other polymeric compounds. The sleeve comprises a thickness, for example a wall thickness, of between 0.1 millimetres and 4 millimetres, for example between 0.2 millimetres and 3 millimetres. Preferably, the sleeve comprises a thickness of between 0.3 millimetres and 2 millimetres, such as 0.5 millimetres and 1.5 millimetres.

The core may comprise a polymeric extrusion, which may be foamed or may have one or more pathways described therealong, or may be foamed and have one or more pathways described therealong. At least one of the pathways may be described within the core extrusion. Alternatively or in addition at least one of the pathways may be described by a channel on an outer surface thereof, for example which cooperates with the sleeve. At least one or each pathway may be helical or helicoidal. The core may comprise a poly lactic acid, acetate or cellulose material. The core may comprise one or more drawn clusters of fibres, which may comprise a wrap, for example, a paper or plastic wrap, surrounding the drawn fibres. The core may be between 2 millimetres and 9 millimetres, for example, the core may comprise a diameter of between 2 millimetres and 9 millimetres. Preferably, the core is between 4 millimetres and 6 millimetres, for example the core comprises a diameter of between 4 millimetres and 7.5 millimetres.

The outer sleeve might be further wrapped into a wrapper, such as paper, to give a specific appearance to the permeation element.

Another aspect of the invention provides an aerosol generating article comprising an aerosol permeation element as described above.

The aerosol generating article may comprise an aerosol generating or sensorial material, for example tobacco. The aerosol generating article may comprise a rod of aerosol generating or sensorial material, which may be connected, secured or attached to the aerosol permeation element, for example a portion thereof may be received within the hollow end. In embodiments, the aerosol generating article comprises a further sleeve within which the aerosol generating or sensorial material is received. The further sleeve may be connected, secured or attached to the aerosol permeation element, for example a portion thereof may be received within the hollow end. An external wrapper might also secure the elements together.

An aerosol generating article comprising:

an aerosol permeation element comprising an aerosol permeable core within a sleeve formed integrally therearound, wherein the aerosol permeable core is shorter than the integrally formed sleeve; and, a rod of aerosol generating material, wherein a portion thereof is received within a hollow end of the aerosol permeation element.

Another aspect of the invention provides a method of manufacturing an aerosol permeation element for use in an aerosol generating article, the method comprising: conveying a plurality of aerosol permeable cores along a conveying path at a first speed or rate; and forming a sleeve around each core at a second speed or rate greater than the first speed or rate to generate a space between consecutive cores within the sleeve.

By selecting the relative speeds or rates, an integral sleeve can be formed having spaces of a predetermined length, thereby providing a series of integral aerosol permeation elements which can then be separated to provide the aerosol permeation elements described above.

The method may comprise conveying the plurality of aerosol permeable cores using a conveying means or conveyor. The method may comprise forming the sleeve around each core using a sleeve forming means or former. The method may comprise separating, for example, cutting or severing, the sleeve or the or each core or the sleeve and the or each core, for example to form a series of aerosol permeation elements. The method may comprise separating the sleeve or each core or sleeve and each core, using a separation means or separator.

The sleeve may be separated between each core, for example at or adjacent a first end of each core or at a location substantially equidistant from each adjacent core. The sleeve and core may both be separated at or adjacent the centre or a central portion of the core.

The series of aerosol permeation elements may be formed such that each of the aerosol permeation elements comprises a first, hollow end and a second end with at least part of one of the cores.

In some embodiments, each core is equivalent to the length required for each aerosol permeation elements. In such embodiments, the sleeve may be separated at or adjacent a first end of each core.

In other embodiments, each core may be longer than, for example, double the length of, the length required for each aerosol permeation elements. In such embodiments, the method may comprise separating both the sleeve and each core at one or more or a series of first positions or separating the sleeve, for example only the sleeve, at one or more or a series of second positions, for example, between each consecutive pair of cores. Each first position may be at or adjacent the centre or a central portion of one of the cores. Each second position may be at a location substantially equidistant from each adjacent core.

The method may comprise supplying an extrusion to form the plurality of cores, for example using a core delivery means. The method may comprise separating or cutting or severing the extrusion, for example using a core cutting means or station. The extrusion may be continuous or may have one or more pathways described therealong or may be continuous and have one or more pathways described therealong. The method may comprise extruding a core material, for example through a core die, to form the extrusion. The method may comprise supplying the extrusion from the core die to form the plurality of cores. The method may comprise drawing the extrusion through a cooling media or bath. The extrusion may be drawn such that it forms a substantially conical shape, for example downstream of the core die or between the core die and the cooling media or bath. Alternatively, the method may comprise supplying the extrusion as a pre-formed extrusion. The method may comprise supplying the extrusion from a delivery device, such as a roll.

The method may comprise extruding a sleeve material, for example through a sleeve die, to form the sleeve around the cores. The method may comprise drawing the extruded sleeve containing cores, for example at the second speed or rate. The cores may be supplied through the sleeve die, for example through a passage, an opening or aperture, which may be central, through the sleeve die. The sleeve die may comprise an outlet having or forming a diameter or annulus which surrounds the passage. In specific embodiments the sleeve die is larger, for example, substantially larger, than the cores. The method may comprise drawing the extruded sleeve containing cores such that the sleeve extrusion forms a substantially conical shape, for example downstream of the sleeve die.

The method may comprise drawing the extruded sleeve containing cores through a cooling media or bath. The method may comprise drawing the extruded sleeve containing cores through a secondary die or diameter verification device. The extruded sleeve containing cores may be drawn such that the sleeve extrusion forms a substantially conical shape between the sleeve die and the cooling media or bath. The extruded sleeve containing cores may be drawn such that the sleeve extrusion forms a substantially conical shape between the sleeve die and the secondary die or diameter verification device.

Another aspect of the invention provides a method of manufacturing an aerosol generating article comprising manufacturing an aerosol permeation element as described above and combining the aerosol permeation element with a rod containing sensory media, for example, tobacco.

The aerosol generating article may comprise an aerosol generating or sensorial material, for example tobacco. The aerosol generating article may comprise a rod of aerosol generating or sensorial material, which may be connected, secured or attached to the aerosol permeation element, for example a portion thereof may be received within the hollow end. In embodiments, the aerosol generating article comprises a further sleeve within which the aerosol generating or sensorial material is received. The further sleeve may be connected, secured or attached to the aerosol permeation element, for example a portion thereof may be received within the hollow end.

Another aspect of the invention provides a series of integral aerosol permeation elements for use in aerosol generating articles comprising a plurality of cores spaced from one another within a sleeve formed integrally therearound.

The series of integral aerosol permeation elements may comprise an intermediate product of the aforementioned method of manufacturing aerosol permeation elements.

Another aspect of the invention provides an aerosol permeation element of an aerosol generating article, the aerosol permeation element comprising a severed section of a series of integral aerosol permeation elements as described above. Yet another aspect of the invention provides an aerosol generating article comprising such an aerosol permeation element.

Another aspect of the invention provides an apparatus for manufacturing an aerosol permeation element of an aerosol generating article, the apparatus comprising: a conveying means or conveyor for conveying a plurality of aerosol permeable cores along a conveying path at a first speed; and a sleeve forming means or former for forming a sleeve around each aerosol permeable core at a second speed, wherein the second speed is greater than the first speed to generate a space between consecutive aerosol permeable cores within the sleeve.

The sleeve forming means may comprise a sleeve extruder, for example, for extruding the sleeve around each core. The sleeve forming means may comprise a sleeve die, which may comprise an inlet from which sleeve material, for example, molten sleeve material, is received, in use, from the sleeve extruder. The sleeve die may comprise a central passage, for example an opening or aperture. The conveying path may pass through the central passage. The conveying means may be configured or operable to convey, in use, a plurality of aerosol permeable cores through the central passage. The sleeve die may comprise an outlet, which may surround the conveying path or central passage or both the conveying path and central passage, for example, for supplying, in use, extruded sleeve material around a plurality of cores passing through the central passage.

The apparatus may comprise a drawing means, mechanism or device, which may be downstream of the sleeve forming means, for drawing the sleeve containing cores. The drawing means may comprise a pulling device, which may comprise a motor and a conveying means or conveyor for pulling or drawing the sleeve containing cores. The conveying means may comprise one or more, such as a set or pair of, pulling rollers.

The apparatus may comprise an aerosol permeation element separation means or separator. The apparatus or separation means may comprise a cutting means or station, for example, for cutting the formed sleeve and core into a plurality of aerosol permeation elements. The cutting means or station may be downstream of the sleeve forming means or drawing means or downstream of both the sleeve forming means and drawing means. The cutting means may be for separating, cutting or severing a sleeve or core exiting the sleeve forming means, or separating, cutting or severing both the sleeve and core exiting the sleeve forming means, to form a series, for example the aforementioned series, of aerosol permeation elements.

The apparatus may comprise a core delivery means or device, for example, for delivering the plurality of cores to the conveying means. The core delivery means may comprise a core cutting means or station, for example, for receiving and severing a continuous extrusion to form the plurality of cores.

In some embodiments, the core delivery means comprises a supply, for example a roll, of pre-formed core extrusion. The supply may be operatively connected to the core cutting means, for example, for supplying the pre-formed core extrusion to the core cutting means.

Alternatively, the apparatus or core delivery means may comprise a core forming means or former. The core forming means may comprise a core extruder, for example, for forming an extrusion, which may be continuous or may have one or more pathways described therealong or may be continuous and have one or more pathways described therealong. The core forming means may comprise a core die, which may comprise a female portion or part or one or more male portions or parts or both female and male portions or parts. The female portion or part may comprise an outer wall, for example, for forming an outer surface of the extrusion. The or each male portion or part may comprise a core, which may be suspended or secured within the female portion. The or each male portion or part may be configured or suitable for forming one of the pathways along the extrusion. The male portion or part may be rotatable, for example within the female part, for example, such that the core members create helical or helicoidal pathways within the extrusion.

The core forming means may comprise a core cooling means, such as a cooling bath that may comprise or contain cooling media therein. The core cooling means may be downstream of the core extruder or core die or downstream of both the core extruder and the core die. The core forming means may comprise a core drawing means, mechanism or device, which may be downstream of the core extruder or core die or core cooling means or any combination thereof, for drawing the core extrusion. The core forming means may be configured such that the core extrusion is drawn, in use, to form a substantially conical shape, for example downstream of the core die or between the core die and the core cooling means. The core forming means may be configured or operable to vary the speed of rotation of the male part relative to a speed at which the core is drawn, for example, to create a predetermined helical angle of the pathways. The core drawing means, mechanism or device may comprise a motor and a conveying means or conveyor for pulling or drawing the sleeve containing cores. The conveying means may comprise a pulling device, which may comprise one or more, such as a set or pair of, pulling rollers. The core cutting means may be downstream of the core extruder or core die or core drawing means, or any combination thereof.

For the avoidance of doubt, any of the features described herein apply equally to any aspect of the invention. For example, the aerosol generating article may comprise any one or more features of the aerosol permeation element or series of aerosol permeation elements or vice versa. The method may comprise any one or more features or steps relevant to one or more features of the aerosol permeation element, the series of aerosol permeation elements or aerosol generating article.

In combination with other features, specific embodiments may further comprise a computer program element comprising computer readable program code means for causing a processor to execute a procedure to implement one or more steps of the aforementioned method.

In combination with other features, specific embodiments may further comprise a computer program element embodied on a computer readable medium.

In combination with other features, specific embodiments may further comprise a computer readable medium having a program stored thereon, where the program is arranged to make a computer execute a procedure to implement one or more steps of the aforementioned method.

In combination with other features, specific embodiments may further comprise a control means or control system or controller comprising the aforementioned computer program element or computer readable medium.

All scientific and technical terms used herein have meanings commonly used in the art unless otherwise specified. The definitions provided herein are to facilitate understanding of certain terms used frequently herein.

As used herein, the term "aerosol generating article" refers to an article comprising an aerosol forming substrate that is capable of releasing volatile compounds that can form an aerosol, for example by heating, combustion or chemical reaction.

As used herein, the term "aerosol forming substrate" is used to describe a substrate capable of releasing volatile compounds, which can form an aerosol. The aerosols generated from the aerosol forming substrates of aerosol generating articles according to the invention may be visible or invisible and may include vapours (for example, fine particles of substances, which are in the gaseous state, that are ordinarily liquid or solid at room temperature) as well as gases and liquid droplets of condensed vapours.

As used herein, the term "sheet" denotes a laminar element having a width and length greater than the thickness thereof.

As used herein, the term "aerosol permeation element" is used to describe an element that allows permeation of an aerosol through it, partially or fully. Typically, the aerosol permeation element will be, but not limited to, a filter, a spacer or a cooling element. The aerosol permeation element may have a combination of functions.

As used herein, the term "sleeve" is used to describe a partial or full cover. Ideally partially covering the longitudinal outer surface of the core of the aerosol permeation element. The term "core", as used herein, is used to describe the inner portion of the aerosol permeation element at least partially covered by the sleeve of the aerosol permeation element.

The terms "upstream" and "downstream" refer to relative positions of elements of the aerosol generating article described in relation to the direction of inhalation air flow as it is drawn through the body of the aerosol generating article from a distal, tip end to the mouthpiece end. In other words as used herein, "downstream" is defined relative to air flow during use of the smoking article or aerosol generating article, with the mouthpiece end of the article being the downstream end through which air and aerosol is drawn. The end opposite the mouthpiece end is the upstream end.

The words "preferred" and "preferably" refer to embodiments of the invention that may afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the disclosure, including the claims.

Throughout the description and claims of this specification, the words "comprise" and "contain" and variations of them mean "including but not limited to", and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Within the scope of this application it is expressly intended that the various aspects, embodiments, examples and alternatives set out in the preceding paragraphs, in the claims in the description and drawings, and in particular the individual features thereof, may be taken independently or in any combination. That is, all embodiments or features of any embodiment can be combined in any way, unless such features are incompatible. For the avoidance of doubt, the terms "may", "and/or", "e.g.", "for example" and any similar term as used herein should be interpreted as non-limiting such that any feature so-described need not be present. Indeed, any combination of optional features is expressly envisaged without departing from the scope of the invention, whether or not these are expressly claimed. The applicant reserves the right to change any originally filed claim or file any new claim accordingly, including the right to amend any originally filed claim to depend from or incorporate any feature of any other claim although not originally claimed in that manner.

Embodiments of the invention will now be described by way of example only with reference to the accompanying drawings in which.

Figure 2:
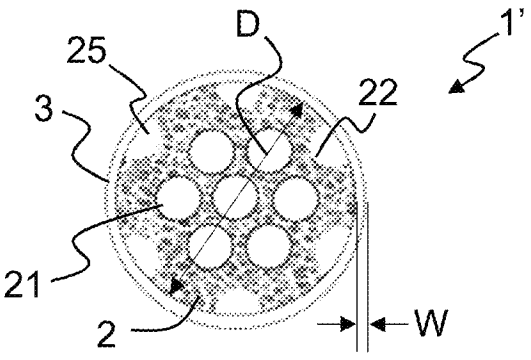
FIG. 2 is cross-sectional view of an aerosol permeation element according to another embodiment of the invention.
Figure 1:
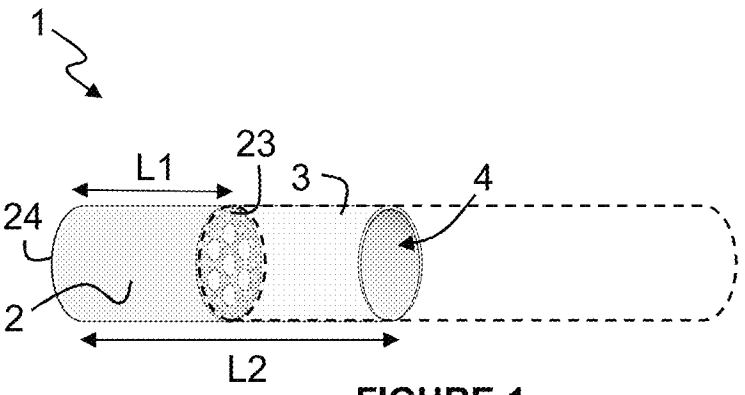
FIG. 1 is a perspective view of an aerosol permeation element according to an embodiment of the invention.

Referring now to FIGS. 1 and 2, there is shown two variations of an aerosol permeation element or filter part 1, 1' according to embodiments of the invention for use in an aerosol 20 generating article (shown in outline). The filter part 1, 1' includes an aerosol permeable core 2 of extruded polymeric filter material within an extruded polymeric sleeve 3 surrounding it.

The core 2 has a plurality of pathways 21 described within it and the configuration shown in FIG. 2 also includes a plurality of channels 22 described in an outer surface thereof. The pathways 21 and channels 22 extend along the axial length L1 of the core 2. The core 2 has first end surface 23 and second end surface 24, spaced from one another by the distance L1. The core 2 is formed from a poly lactic acid (PLA) material in this embodiment and has a diameter D of 5 millimetres.

The sleeve 3 surrounds and is formed integrally with the core 2 and is also formed from poly lactic acid (PLA) in this embodiment. The sleeve 3 has a wall thickness W of 1 millimetre and an axial length L2. The length L2 of the sleeve 3 is greater than the length L1 of the core 2, such that the filter part 1, 1' has a hollow end 4 beyond the first end surface 23 of the core 2. The second end 24 of the core 2 is aligned with an end surface of the sleeve 3. The channels 22 in the outer surface of the core 2 define, together with the internal surface of the sleeve 3, pathways 25.

In use, the hollow end 4 of the filter part 1, 1' allows part of the aerosol generating article to be mounted therein to provide a degree of overlapping interface between the aerosol generating article and the filter part 1, 1'. The inner surface of the sleeve 3 may provide a friction fit with another part of the aerosol generating article. In some embodiments, the sleeve 3 extends the entire length of the aerosol generating article, such that the aerosol generating substance is contained within the hollow end 4.

Figure 3:
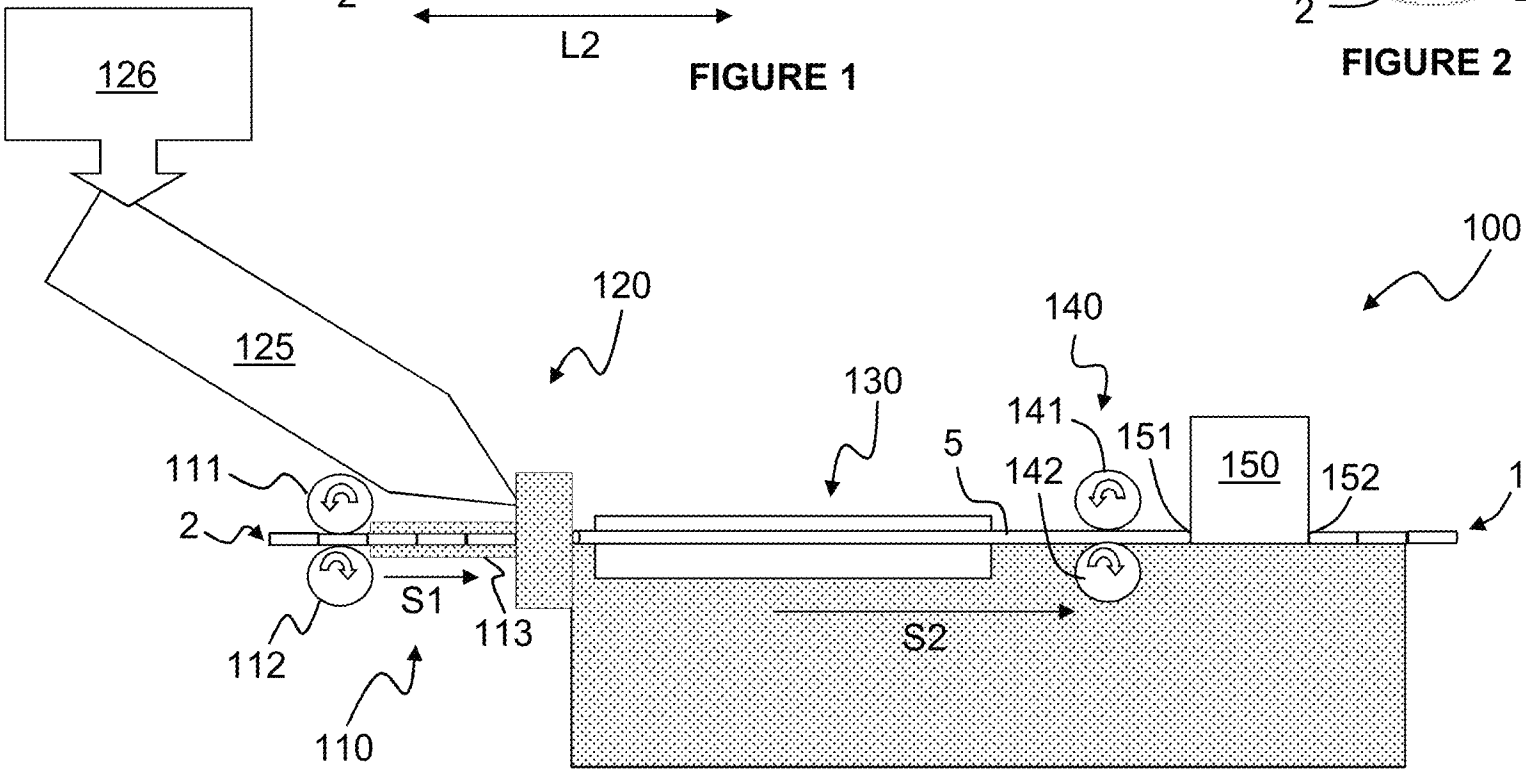
FIG. 3 is a schematic of a filter manufacturing apparatus according to an embodiment of the invention.
Figure 4:
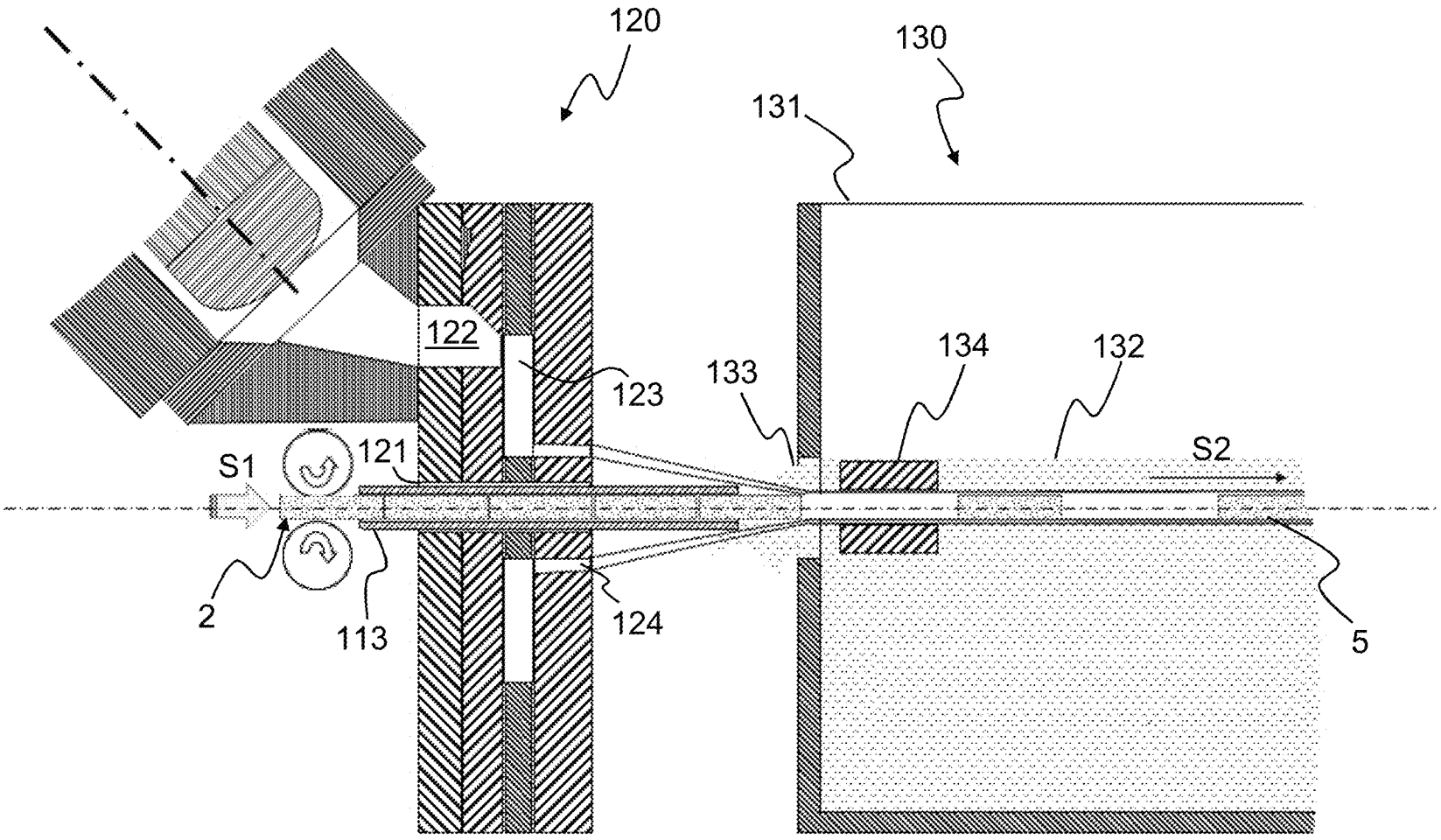
FIG. 4 is a schematic of part of the filter manufacturing apparatus of FIG. 3.

Referring now to FIGS. 3 and 4, there is shown an apparatus 100 for manufacturing a filter part 1, 1' as described above. The apparatus 100 includes a core feed 110, which feeds cores 2 through an extrusion die 120 at a predetermined speed S1. Extruded sleeve material is fed continuously from a screw extruder 125 through the die 120 and is deposited on the cores 2 to form a continuous length of filter rod 5. The filter rod 5 is drawn from the die 120 at speed S2, which is greater than core feed speed S1. This difference in speed (S2–S1) creates a space between consecutive cores 2 within the extruded sleeve material. The so-formed filter rod 5 is drawn through a cooling unit 130 downstream of the die 120 using a drawing mechanism 140 and on to a cutting station 150 for severing the continuous length of filter rod 5 to produce a plurality of filter parts 1, 1'.

The filter feed 110 has a pair of opposed, counter-rotating feed rollers 111, 112 configured to rotate at speed R1 to provide the core feed speed S1. As illustrated more clearly in FIG. 4, a feed tube 113 is provided downstream of the feed rollers 111, 112. The feed tube 113 has an inner diameter slightly greater than the diameter D of the cores 2. The feed tube 113 is configured to correctly position each respective core 2 as it is fed into the die 120 and protrudes from both the upstream and downstream sides of the die 120. The die 120 has a central aperture 121 through which the feed tube 113. The die 120 also has a feed channel 122, which feeds into an annular chamber 123 and out through an annular passage 124. The annular chamber 123 and annular passage 124 both surround the central aperture 121. The extruder 125 has a hopper 126 for feeding raw material thereto, which is melted and fed into the annular chamber 123. The raw material is in the form of poly lactic acid (PLA) resin in this embodiment.

Downstream of the die 120 is the cooling unit 130, which includes a tank 131 containing a cooling medium, which is water 132 in this embodiment. Extruded material is drawn from the annular passage 124 of the die 120, into a cooling inlet 133 in a wall of the tank 131 and through a diameter verification device 134, which is below the surface of the water 132. The diameter verification device 134 is tubular with an internal diameter which is substantially the same as the diameter of the filter rod 5 and substantially smaller than the annular passage 124. As such, the extruded material forms a conical tube as it passes from the annular passage 124 of the die to the cooling inlet 133 of the tank 131.

The drawing mechanism 140 is downstream of the cooling unit 130 and includes a pair of opposed, counter-rotating pulling rollers 141, 142 arranged to receive the filter rod 5 after it has passed through the cooling unit 130. The pulling rollers 141, 142 receive the filter rod 5 therebetween, draw it through the cooling unit 130 and covey it towards the cutting station 150 at speed S2. The cutting station 150 has an inlet 151, a cutter (not shown) for cutting the filter rod 5 into filter parts 1, 1' and an outlet 152 through which the filter parts 1, 1' are expelled.

In use, cores 2 are fed into the feed tube 113 by the feed rollers 111, 112. Each successive core 2 fed into the feed tube 113 pushes the others along the conveying direction of the apparatus 100 and into the die 120. As the cores 2 are conveyed, they pass through the die 120 and exit the feed tube 113 into the conical tubular extrusion of material as it enters the cooling inlet 133 of the tank 131. The sleeve material from the annular passage 124 of the die 120 is drawn at speed S2 as it contacts each core 2 and enters the cooling inlet 133 of tank 131. As such, the cores 2 are drawn into the cooling inlet 133 of the tank 131 at speed S2 as they come into contact with extruded sleeve material from the die 120, which creates a space between consecutive cores 2 in the filter rod 5.

As the filter rod 5 is drawn through the cooling unit 130 by the drawing mechanism 140, it cools and solidifies the extruded sleeve 3. The filter rod 5 is also drawn through the diameter verification device 134 which ensures the diameter of the filter rod 5 is correct. The filter rod 5 is then fed into the cutting station 150 through the inlet 151 and is cut to form the filter parts 1, 1', which then exit the cutting station 150 through the outlet 152.

Figure 5:
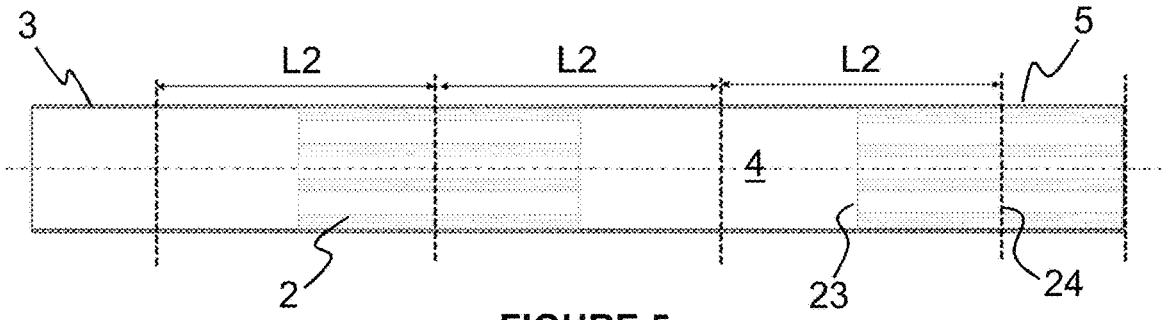
FIG. 5 illustrates the positions at which the filter rod may be severed by the apparatus of FIG. 3.

Turning now to FIG. 5, the filter rod 5 may be cut into regular segments by providing a first cut through the core 2 and sleeve 3 at the midpoint of the core 2 and a second cut through the sleeve 3 at the midpoint of the space between adjacent cores 2. This cutting arrangement produces filter parts 1, 1' with a core 2 having length L1 which is half of the length of the core 2 supplied to the apparatus 100 at the core feed 110. This cutting arrangement also produces a sleeve 3 with a length L2, which greater than L1. As such, the filter part 1, 1' has the hollow end 4 adjacent the first end 23 of the core 2 and the second end 24 of the core 2 aligned with an end surface of the sleeve 3. Alternatively, the cores 2 supplied to the apparatus 100 may have a length equal to L1, wherein the sleeve 3 of the filter rod 5 is simply cut adjacent the second end 24 of each consecutive core 2.

Figure 6:
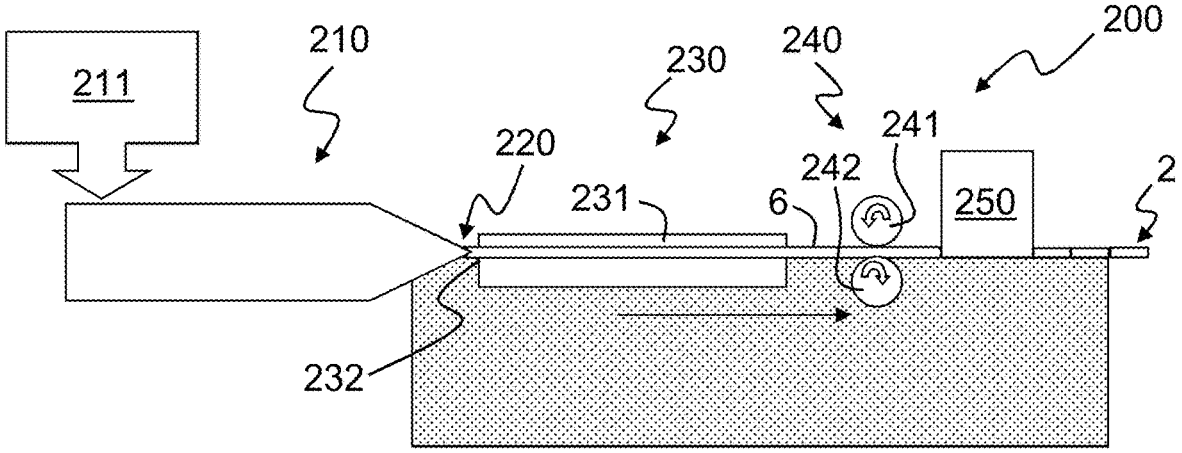
FIG. 6 is a schematic of a core former according to an embodiment of the invention.
Figure 7:
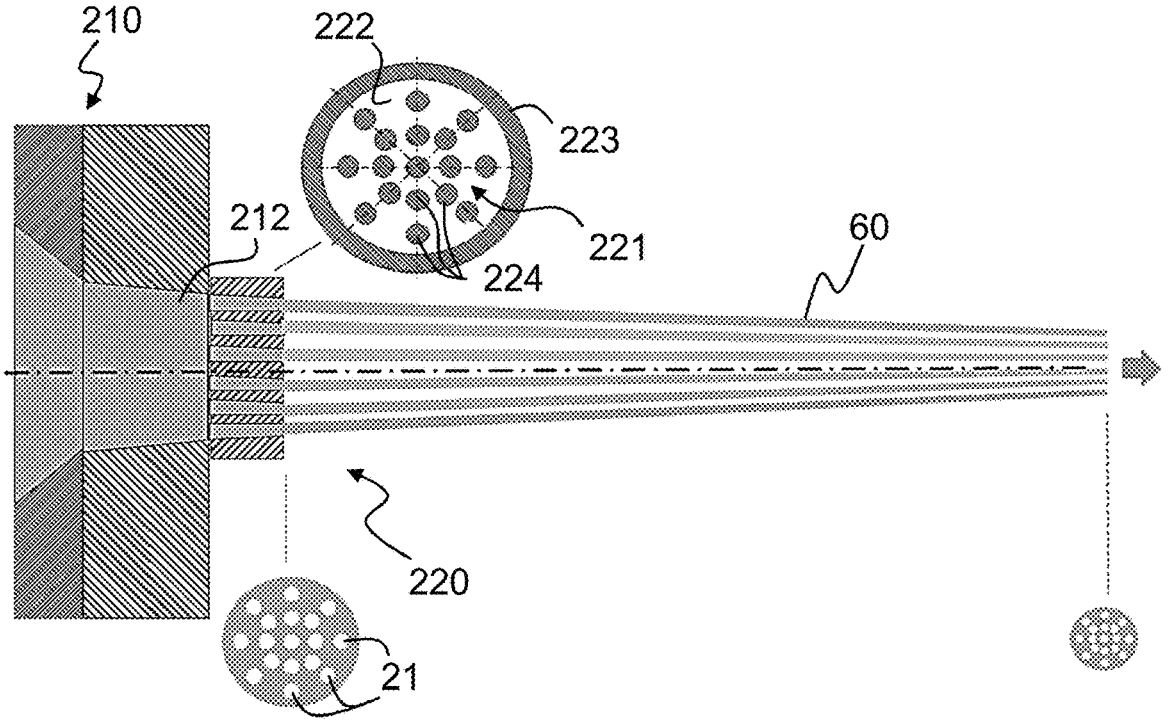
FIG. 7 is a cross-sectional view through the core die of the core former of FIG. 6.

FIGS. 6 and 7 show an optional core former 200 for use with the apparatus 100. The core former 200 includes an extruder 210, which forms a continuous extruded core 6 through a core die 220. The extruded core 6 is drawn from the core die 220 through a cooling unit 230 using a core drawing mechanism 240. Downstream of the core drawing mechanism 240, the extruded core 6 is fed into a core cutting station 250, which severs the extruded core 6 to produce a plurality of cores 2 for supply to the apparatus 100.

The core extruder 210 has a hopper 211 for feeding raw material, a poly lactic acid (PLA) resin in this embodiment, to the core extruder 210. At the downstream end of the core extruder 210 is a flow channel 212 leading to the core die 220. The core die 220 has a male part 221 and a female part 222 described by an outer wall 223 that defines the outer surface of the extrusion. The male part 221 is supported within the female part 222 by support elements (not shown) and has a plurality of core members 224 each having a circular cross-section for creating the pathways 21 within the extrusion. The circular core members 224 together define a star pattern so as to form the pathways 21 along the extrusion 6. The core die 220 is attached to the outlet of the core extruder 210 for receiving molten material therefrom. Optionally, the male part 221 may rotate within the female part 222 such that the core members 224 create helical or helicoidal pathways 21 within the extrusion. The helical angle of the pathways 21 may be controlled by the speed of rotation of the male part 221 relative to the drawing speed of the extrusion.

Downstream of the core die 220 is the cooling unit 230 which, similar to the cooling unit 130 of apparatus 100, includes a tank 231 having a cooling medium therein. Extruded material 60 is drawn by the drawing mechanism 240 from the extruder 210 into a cooling inlet 232 in a wall of the tank 231, which causes it to form a conical extrusion 60 in a similar manner to the sleeve extrusion process described above. The drawing mechanism 240 includes a pair of opposed, counter-rotating pulling rollers 241, 242 arranged to draw the extruded core 6 from the cooling unit 230. The pulling rollers 241, 242 convey the extruded core 6 into the core cutting station 250, which cuts the core extrusion 6 into individual cores 2.

In use, raw material for forming the cores 2 is fed from the hopper 211 through the extruder 210. Extruded core material 60 is drawn through the cooling unit 230 by the drawing mechanism 240, which cools and solidifies it into the core extrusion 6 ready for further processing. The core extrusion 6 is drawn by the pulling rollers 241, 242 of the drawing mechanism 240 and fed to the cutting station 250.

The core former 200 may be located upstream of the core feed 110 shown in FIGS. 3 and 4. The cores 2 produced at the outlet 252 of the core cutting station 250 may be fed to the inlet of the core feed 110. In other embodiments, the core former 200 is completely separate from the apparatus 100.

In some embodiments, the core former 200 may not have a core cutting station 250 and instead the extruded core may be stored on a roll. In such a case, the apparatus 100 may have a core cutter upstream of the core feed 110 so as to form cores 2 prior to feeding. Other arrangements are also envisaged.

It will be appreciated by those skilled in the art that the parameters of the filter part 1, 1' may be altered by changing one or more processing parameters. For example, the thickness of the sleeve 3 may be increased or decreased by modifying the relationship between the drawing speed S2 and the rate at which extruded material is supplied by the extruder 125.

As such, the invention provides a versatile means of producing aerosol permeation elements 1 whose characteristics can be varied across a wide range.

It will be appreciated by those skilled in the art that several variations to the aforementioned embodiments are envisaged without departing from the scope of the invention. For example, the cooling medium in the cooling units 130, 230 is described as being water. This need not be the case and instead, any suitable cooling medium may be used. The extruded sleeve 3 and core 2 may be formed of different materials to those described above. Additionally or alternatively, the core 2 may, but need not, be formed of a foamed material.

It will also be appreciated by those skilled in the art that any number of combinations of the aforementioned features or those shown in the appended drawings provide clear advantages over the prior art and are therefore within the scope of the invention described herein.

EXAMPLES

1. An aerosol permeation element for use in an aerosol generating article, the aerosol permeation element comprising an aerosol permeable core within a sleeve formed integrally therearound, wherein the core is shorter than the integrally formed sleeve.

2. Aerosol permeation element according to example 1, wherein the core is no more than half of the length of the sleeve.

3. Aerosol permeation element according to example 1 or example 2, wherein the sleeve comprises a polymeric extrusion.

4. Aerosol permeation element according to any preceding example, wherein the core comprises a foamed polymeric extrusion with one or more pathways described therealong.

5. Aerosol permeation element according to any preceding example, wherein the sleeve comprises a poly lactic acid material.

6. Aerosol permeation element according to any preceding example, wherein the core comprises a poly lactic acid, acetate or cellulose material.

7. Aerosol permeation element according to any preceding example, wherein the sleeve comprises a wall thickness of between 0.3 millimetres and 3 millimetres.

8. Aerosol permeation element according to any preceding example, wherein the core comprises a diameter of between 4 millimetres and 7.5 millimetres.

9. An aerosol generating article comprising an aerosol permeation element according to any preceding example.

The invention claimed is:

1. A method of manufacturing an aerosol permeation element for use in an aerosol generating article, the method comprising:

conveying a plurality of aerosol permeable cores along a conveying path at a first speed; and forming a sleeve around each core at a second speed greater than the first speed to generate a space between consecutive cores within the sleeve.

2. The method according to claim 1 comprising severing the sleeve between adjacent aerosol permeable cores to form a series of aerosol permeation elements each comprising a first, hollow end and a second end with at least part of one of the aerosol permeable cores.

3. The method according to claim 2 comprising severing both the sleeve and each aerosol permeable core at a series of first positions and severing the sleeve at a series of second positions between each consecutive pair of aerosol permeable cores to form the series of aerosol permeation elements each comprising a first, hollow end and a second end with part of one of the aerosol permeable cores.

4. The method according to claim 1 comprising supplying and severing a continuous extrusion having one or more pathways described therealong to form the plurality of aerosol permeable cores.

5. The method according to claim 4 comprising extruding a core material through a core die to form the continuous extrusion and supplying and severing the continuous extrusion from the core die to form the plurality of aerosol permeable cores.

6. The method according to claim 1 comprising extruding a sleeve material through a sleeve die to form the sleeve around the aerosol permeable cores.

7. An apparatus for manufacturing an aerosol permeation element of an aerosol generating article, the apparatus comprising:

a conveyor configured to convey a plurality of aerosol permeable cores along a conveying path at a first speed;

a sleeve former configured to form a sleeve around each aerosol permeable core at a second speed, wherein the second speed is greater than the first speed to generate a space between consecutive aerosol permeable cores within the sleeve; and a computer program element comprising computer readable program code configured to cause the conveyor to convey the plurality of aerosol permeable cores along the conveying path at the first speed and to cause the sleeve former to form the sleeve around each aerosol permeable core at the second speed.

* * * * *